US011413647B2

(12) United States Patent
Ooshiro et al.

(10) Patent No.: US 11,413,647 B2
(45) Date of Patent: Aug. 16, 2022

(54) PUMP AND COATING DEVICE

(71) Applicant: KIOXIA CORPORATION, Tokyo (JP)

(72) Inventors: Kenichi Ooshiro, Kanagawa (JP); Yuta Sugimoto, Kanagawa (JP)

(73) Assignee: KIOXIA CORPORATION, Tokyo (JP)

( * ) Notice: Subject to any disclaimer, the term of this patent is extended or adjusted under 35 U.S.C. 154(b) by 33 days.

(21) Appl. No.: 16/806,508

(22) Filed: Mar. 2, 2020

(65) Prior Publication Data

US 2020/0298269 A1 Sep. 24, 2020

(30) Foreign Application Priority Data

Mar. 20, 2019 (JP) ..... JP2019-052314

(51) Int. Cl.

| | |
|---|---|
| ***B05C 5/02*** | (2006.01) |
| ***F04B 53/16*** | (2006.01) |
| ***B05B 9/04*** | (2006.01) |
| ***F04B 53/00*** | (2006.01) |
| ***F04B 53/14*** | (2006.01) |

(Continued)

(52) U.S. Cl.

CPC ..... *B05C 5/0225* (2013.01); *B05B 9/0409* (2013.01); *B05B 9/0413* (2013.01); *B05C 5/027* (2013.01); *B05C 11/10* (2013.01); *F04B 49/02* (2013.01); *F04B 53/00* (2013.01); *F04B 53/06* (2013.01); *F04B 53/144* (2013.01); *F04B 53/16* (2013.01)

(58) Field of Classification Search

CPC ..... F04B 53/00; F04B 53/06; F04B 53/144; F04B 53/16; F04B 9/103; F04B 9/105; F04B 9/107; F04B 7/0003; F04B 49/02; B05B 9/0413; B05B 9/0409; H01L 21/67017; F15B 15/1442; F15B 21/041; B05C 5/0225; B05C 5/027; B05C 5/02; B05C 11/1013; B05C 11/10; A61B 5/150221; A61B 5/150236; A61B 5/150244; A61B 5/150251

USPC ..... 417/92, 102–104, 112, 555.1, 297; 92/86; 118/696, 683, 302, 313, 429

See application file for complete search history.

(56) References Cited

U.S. PATENT DOCUMENTS 3,771,908 A * 11/1973 Rosen ..... F04B 15/02 417/446
2004/0170772 A1* 9/2004 Morita ..... F04B 53/06 427/430.1

(Continued)

FOREIGN PATENT DOCUMENTS

CN 1530176 A 9/2004
CN 101053861 A 10/2007

(Continued)

*Primary Examiner* — Laura Edwards
(74) *Attorney, Agent, or Firm* — Foley & Lardner LLP

(57) ABSTRACT

According to one embodiment, a pump includes a first chamber configured to store a first fluid. The pump includes a second chamber configured to store a second fluid, the second chamber being positioned on a side of the first chamber. Volume of a space of the second chamber configured to store the second fluid is variable. The pump includes an elongated member having a first end portion and a second end portion, the first end portion provided in the second chamber and the second end portion provided in the first chamber.

10 Claims, 5 Drawing Sheets

(51) Int. Cl.

| | |
|---|---|
| ***F04B 49/02*** | (2006.01) |
| ***B05C 11/10*** | (2006.01) |
| ***F04B 53/06*** | (2006.01) |

(56) References Cited

U.S. PATENT DOCUMENTS

| | | | |
|---|---|---|---|
| 2008/0260549 | A1 | 10/2008 | Yajima |
| 2015/0202643 | A1 | 7/2015 | Chien |
| 2018/0214876 | A1 | 8/2018 | Muldoon et al. |

FOREIGN PATENT DOCUMENTS

| | | | |
|---|---|---|---|
| CN | 101165348 | A | 4/2008 |
| CN | 107106091 | A | 8/2017 |
| JP | 2007-287831 | A | 11/2007 |
| JP | 4184124 | B2 | 11/2008 |
| JP | 4592524 | B2 | 12/2010 |
| TW | 201529975 | A | 8/2015 |

* cited by examiner

PUMP AND COATING DEVICE

CROSS-REFERENCE TO RELATED APPLICATION(S)

This application is based upon and claims the benefit of priority from Japanese Patent Application No. 2019-052314, filed Mar. 20, 2019, the entire contents of which are incorporated herein by reference.

FIELD

Embodiments described herein relate generally to a pump and a coating device.

BACKGROUND

A coating device can apply a fluid onto an object such as a substrate. Such a coating device includes a pump that supplies a fluid. The pump used in the coating device is a syringe pump, a diaphragm pump, a gear pump or the like, and the syringe pump having excellent discharge responsiveness, constant flow rate, and the like may be used when a relative speed between an object and a nozzle changes.

When a rod provided in the syringe pump is reciprocated, a fluid adhered to fine irregularities on a side surface of the rod is exposed to an outside air. In the case that the fluid adhered to the side surface of the rod is solidified when being exposed to the outside air, the solidified fluid may be peeled off when the rod is inserted into a storage chamber and mixed into the fluid. The fluid mixed with the solidified substance becomes an impurity, and therefore, the quality of a formed film may decrease. In addition, the outside air may be caught inside the storing chamber when the rod is reciprocated, and air bubbles may be generated in the fluid stored in the storage chamber. When there are air bubbles in the fluid, the discharge responsiveness, the constant flow rate, and the like may deteriorate.

Accordingly, a technique is proposed in which a cleaning chamber connected to the storage chamber is provided and a rod is inserted inside the storage chamber via the cleaning chamber. However, there is room for improvement in preventing generation of air bubbles.

Examples of related art include JP-A-2007-287831.

DETAILED DESCRIPTION

Figure 1:
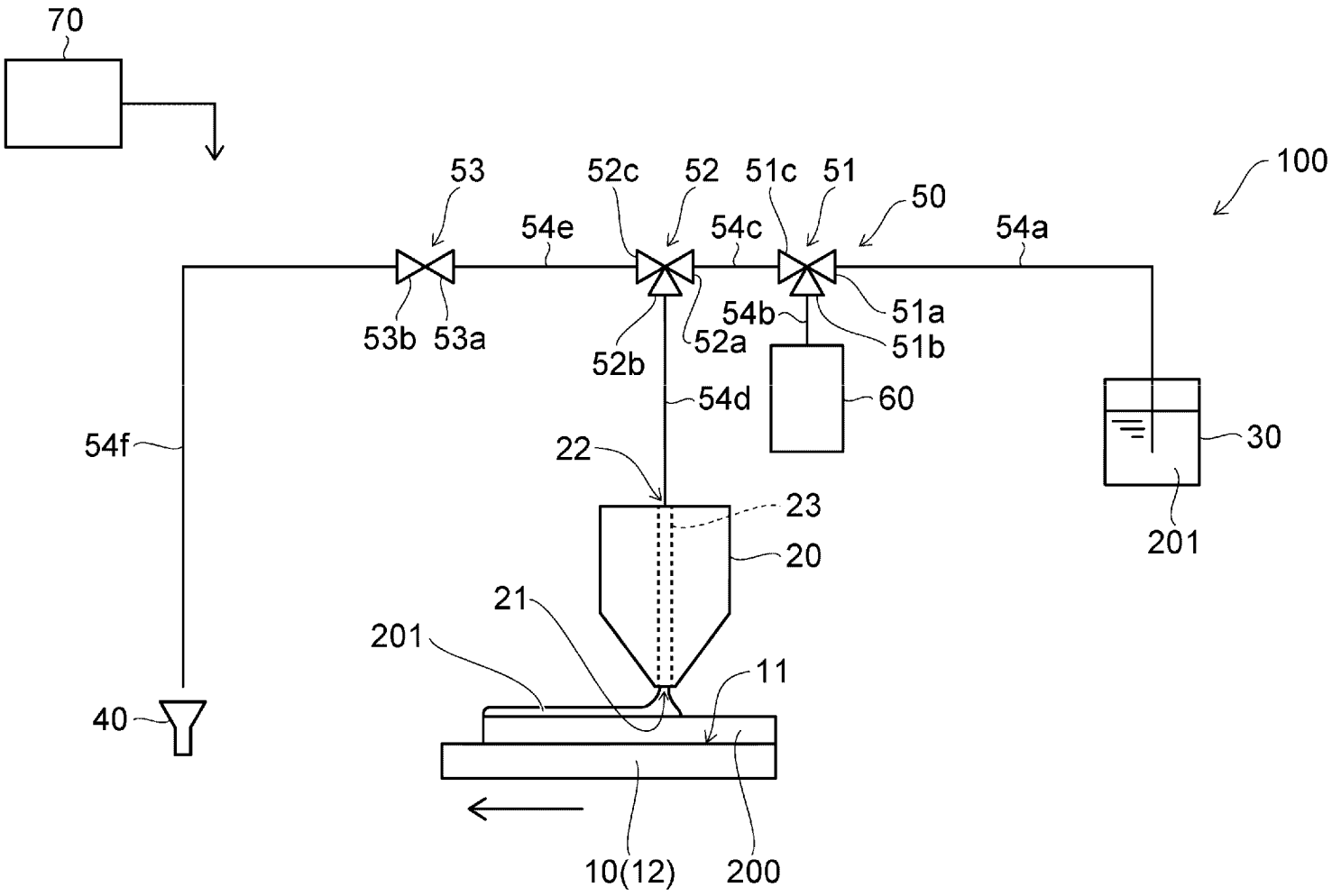
FIG. 1 is a schematic view showing a coating device according to an embodiment.

Embodiments provide a pump and a coating device in which air bubbles can be prevented from being generated in a fluid stored in a storage chamber.

In general, according to one embodiment, a pump includes a first chamber configured to store a first fluid. The pump includes a second chamber configured to store a second fluid, the second chamber being positioned on a side of the first chamber. Volume of a space of the second chamber configured to store the second fluid is variable. The pump includes an elongated member having a first end portion and a second end portion, the first end portion provided in the second chamber and the second end portion provided in the first chamber.

Hereinafter, embodiments will be described with reference to the drawings. In the drawings, the same elements are denoted by the same reference numerals, and the detailed description thereof is omitted as appropriate.

FIG. 1 is a schematic view showing a coating device 100 according to an embodiment.

Figure 2:
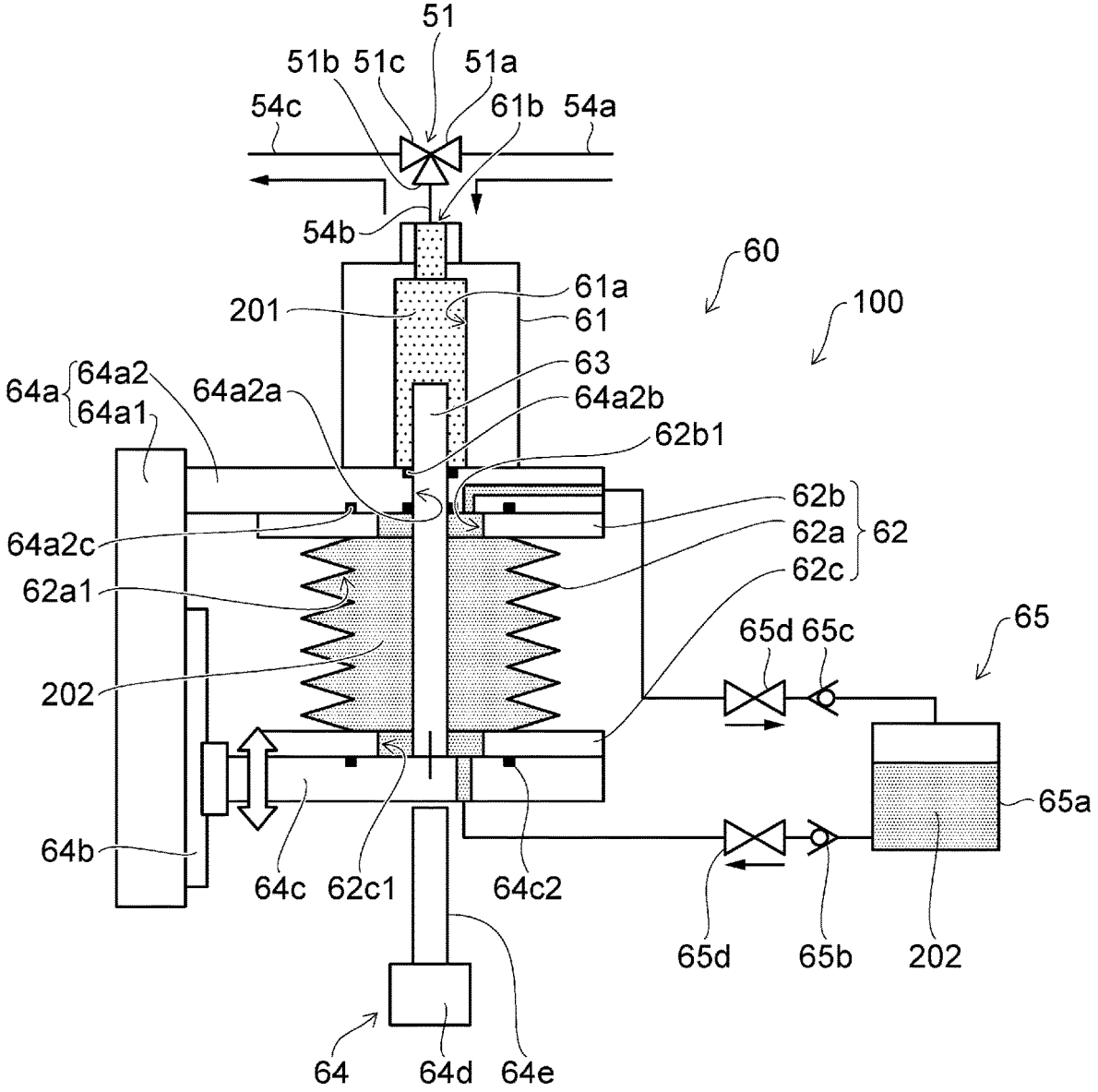
FIG. 2 is a schematic cross-sectional view showing a pump according to the present embodiment.

FIG. 2 is a schematic cross-sectional view showing a pump 60 according to the present embodiment.

Figure 3:
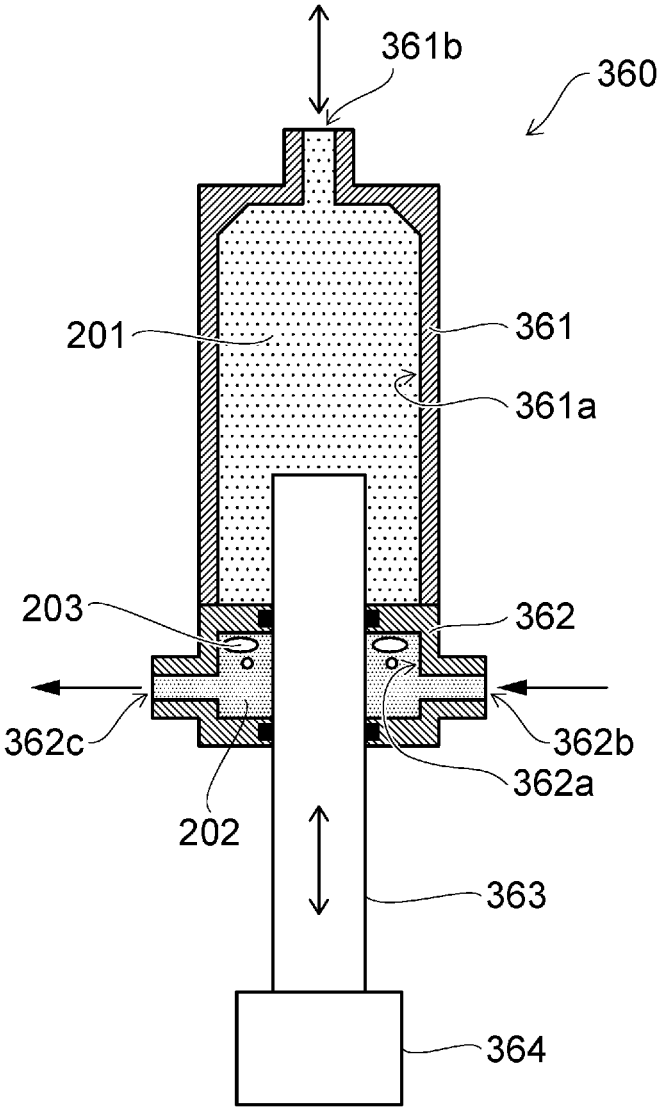
FIG. 3 is a schematic cross-sectional view showing a pump according to a comparative example.

FIG. 3 is a schematic cross-sectional view showing a pump 360 according to a comparative example.

As shown in FIG. 1, the coating device 100 includes a placement unit 10, a nozzle 20, a tank 30, a discharge unit 40, a piping unit 50, a pump 60, and a controller 70.

One surface of the placement unit 10 is a placement surface 11 on which an object 200 is placed.

The object 200 is not particularly limited. For example, as shown in FIG. 1, the object 200 may be a plate-shaped body. In this case, the object 200 may be a semiconductor wafer, a glass substrate or the like.

Further, the placement unit 10 may hold the object 200 placed on the placement surface 11. For example, the placement unit 10 may include an electrostatic chuck, a vacuum chuck, a mechanical chuck or the like, so as to hold, by these chucks, a back surface (surface of a side opposite to a side on which the fluid is applied) of the object 200, a side surface of the object 200, and the like.

In addition, the placement unit 10 is provided with a driving unit 12 that changes a position with respect to the nozzle 20. For example, the placement unit 10 may be an XY table provided with a motor, a rotary table provided with a motor, a conveyor provided with a motor or the like. However, the driving unit 12 may be provided in at least one of the placement unit 10 and the nozzle 20 as long as a relative position between the placement unit 10 (object 200) and the nozzle 20 can be changed. For example, the nozzle 20 may be provided on an arm of a single-axis robot, a two-axis robot, a multi-axis robot or the like.

The nozzle 20 is connected to an opening 61*b* of the pump 60 that discharges a fluid 201. The nozzle 20 discharges the supplied fluid 201 toward the object 200 placed on the placement unit 10.

The fluid 201 is not particularly limited as long as the fluid can be supplied by the pump 60. The fluid 201 may be, for example, a treatment liquid such as an adhesive, a coating material, an ink, a photoresist, and a chemical liquid. A cleaning liquid 202 to be described later is not particularly limited as long as a substance contained in the fluid 201 can be dissolved. The cleaning liquid 202 may be, for example, a solvent contained in the fluid 201.

The nozzle 20 includes a discharge port 21, a supply port 22, and a flow path 23.

The discharge port 21 is provided at an end portion of the nozzle 20 on a placement surface 11 side. The discharge port 21 is not particularly limited as long as the fluid 201 can be supplied in a predetermined range. For example, the discharge port 21 may be a hole, a slit or the like. The nozzle 20 may be a so-called needle nozzle, a slit nozzle or the like.

For example, the supply port 22 is provided at an end portion of the nozzle 20 on a side opposite to the placement surface 11 side, a side surface of the nozzle 20, and the like. A piping joint that connects a pipe or the like is connected to the supply port 22.

The flow path 23 is provided inside the nozzle 20, and connects the discharge port 21 and the supply port 22. The flow path 23 may be a space that guides the fluid 201 supplied from the supply port 22 to the discharge port 21.

A material of the nozzle 20 is not particularly limited as long as the material has resistance to the fluid 201. The nozzle 20 may be formed of, for example, stainless steel or a fluorine resin.

The number and an arrangement of the nozzles 20 are not particularly limited, and may be appropriately changed depending on a size of the object 200, an applying range of the fluid 201, the property of the fluid 201 such as viscosity, and the like. When a plurality of nozzles 20 are provided, the pump 60 may be provided for each of the plurality of nozzles 20, the pump 60 may be provided for each nozzle 20 in a predetermined group, or one pump 60 may be provided with respect to the plurality of nozzles 20.

The tank 30 may store the fluid 201 therein. A material of the tank 30 is not particularly limited as long as the material has resistance to the fluid 201 and has a certain degree of rigidity. The tank 30 may be formed of, for example, stainless steel or a fluorine resin.

The discharge unit 40 may discharge the remaining fluid 201 inside the tank 30 or the pump 60. The discharge unit 40 may be, for example, a waste liquid pod, a factory pipe, or a drain pan.

The piping unit 50 includes a switching valve 51, a switching valve 52, and an on-off valve 53. The switching valve 51, the switching valve 52, and the on-off valve 53 may be electromagnetic valves. The switching valve 51, the switching valve 52, and the on-off valve 53 may be controlled by the controller 70. In some embodiments, the piping unit 50 may further include elements such as a flow rate regulating valve, a pressure regulating valve, and a filter.

The switching valve 51 may be, for example, a three-way valve. The tank 30 is connected to a first port 51*a* of the switching valve 51 via a pipe 54*a*. The pump 60 is connected to a second port 51*b* via a pipe 54*b*. A first port 52*a* of the switching valve 52 is connected to a third port 51*c* via a pipe 54*c*. The switching valve 51 may switch a supply flow path of the fluid 201 by switching open and close states of the first port 51*a*, the second port 51*b*, and the third port 51*c*.

The switching valve 52 may be, for example, a three-way valve. The supply port 22 of the nozzle 20 may be connected to the second port 52*b* of the switching valve 52 via a pipe 54*d*. A first port 53*a* of the on-off valve 53 may be connected to the third port 52*c* via a pipe 54*e*. The switching valve 52 may switch the supply flow path of the fluid 201 by switching open and close states of the first port 52*a*, the second port 52*b*, and the third port 52*c*.

The on-off valve 53 may be, for example, a two-way valve. A pipe 54*f* may be connected to the second port 53*b* of the on-off valve 53. The remaining fluid 201 inside the tank 30 or the pump 60 may be discharged to the discharge unit 40 via the pipe 54*f*. The on-off valve 53 may switch between supply of the fluid 201 and stop of the supply by switching the open and close state.

The pump 60 may supply the fluid 201 to the nozzle 20. The pump 60 may be a so-called syringe pump. The pump 60 will be described in detail later.

The controller 70 includes a storage unit that stores a control program, and a calculation unit that executes the control program. The storage unit may be, for example, a semiconductor memory, or a hard disk. The calculation unit may be, for example, a central processing unit (CPU). If necessary, the controller 70 may further include an input unit, an output unit, and the like. The input unit may be, for example, a keyboard, a mouse for an operator to input process conditions. The output unit may be, for example, a flat panel display that displays an operating state of the coating device 100, a process condition, an abnormal alarm and the like.

For example, the calculation unit controls an operation of each element provided in the coating device 100 based on the control program stored in the storage unit and information input from the input unit. For example, the calculation unit may apply the fluid 201 to a desired region of the object 200 by controlling the operation of each element provided in the coating device 100.

Next, the pump 360 according to a comparative example and the pump 60 according to the present embodiment will be described.

As shown in FIG. 3, the pump 360 according to the comparative example is a syringe pump.

The pump 360 is provided with a storage chamber 361, a cleaning chamber 362, a rod 363, and a driving unit 364.

The storage chamber 361 has a cylindrical shape and includes a space 361*a* for storing the fluid 201 therein. An opening 361*b* is provided on an upper surface of the storage chamber 361. The fluid 201 is supplied to the space 361*a* via the opening 361*b*, and is discharged from the space 361*a* via the opening 361*b*.

The cleaning chamber 362 is provided below the storage chamber 361. A space 362*a* for storing the cleaning liquid 202 is provided inside the cleaning chamber 362. A supply port 362*b* and a discharge port 362*c* are provided on a side surface of the cleaning chamber 362. The cleaning liquid 202 is supplied to the space 362*a* via the supply port 362*b*, and is discharged from the space 362*a* via the discharge port 362*c*.

The rod 363 extends in a direction along which the storage chamber 361 and the cleaning chamber 362 are aligned. One end portion side of the rod 363 is inserted inside the storage chamber 361 and the cleaning chamber 362. A seal member such as an O-ring is provided between the rod 363 and the storage chamber 361 and between the rod 363 and the cleaning chamber 362.

The driving unit 364 is provided on the other end portion side of the rod 363. The driving unit 364 moves the rod 363 in the direction along which the storage chamber 361 and the cleaning chamber 362 are aligned. The fluid 201 inside the space 361*a* is discharged via the opening 361*b* by inserting the rod 363 into the storage chamber 361.

The fluid 201 adhered to a side surface of the rod 363 is removed by the cleaning liquid 202 in the cleaning chamber 362. However, depending on a moving distance of the rod 363, the fluid 201 adhered to the side surface of the rod 363 may be exposed to an outside of the cleaning chamber 362 and solidified. A solidified substance adhered to the side surface of the rod 363 may be peeled off when the rod 363 is inserted into the space 361*a* of the storage chamber 361 and mixed into the fluid 201.

In addition, when the rod 363 is reciprocated, an outside air may be caught inside the space 362*a* of the cleaning chamber 362, and air bubbles 203 may be generated in the cleaning liquid 202. If there are air bubbles 203 in the cleaning liquid 202, when the rod 363 is inserted inside the storage chamber 361, the air bubbles 203 in the cleaning liquid 202 may be caught inside the space 361*a* of the storage chamber 361, and the air bubbles 203 may be generated in the fluid 201. When there are air bubbles 203 in the fluid 201, the discharge responsiveness, the constant flow rate, and the like may deteriorate.

In this case, a mechanism that traps the air bubbles 203 in the cleaning chamber 362 is provided, and the trapped air bubbles 203 may be periodically removed. However, in this way, the structure of the pump 360 is complicated, and the cost and the size of the pump 360 are increased. In addition, it may be desired to perform an operation of removing the trapped air bubbles 203, which may lead to a complicated operation and even a decrease in production efficiency.

In contrast, as shown in FIG. 2, the pump 60 according to the present embodiment includes a storage chamber 61, a cleaning chamber 62, a rod 63, a driving unit 64, and a cleaning liquid supply unit 65.

The storage chamber 61 may store the fluid 201. For example, the storage chamber 61 may have a cylindrical shape, and include a space 61*a* for storing the fluid 201 therein. A material of the storage chamber 61 is not particularly limited as long as the material has resistance to the fluid 201 and has a certain degree of rigidity. The storage chamber 61 may be formed of, for example, stainless steel or a fluorine resin.

The opening 61*b* may be provided on one end portion side of the storage chamber 61. Although FIG. 2 shows a case where the opening 61*b* is provided on one end surface of the storage chamber 61, the present disclosure is not limited thereto. The opening 61*b* may be provided on a side surface of the storage chamber 61, for example.

The second port 51*b* of the switching valve 51 is connected to the opening 61*b* via the pipe 54*b*.

By opening the first port 51*a* and the second port 51*b* and closing the third port 51*c*, the fluid 201 stored in the tank 30 is supplied to the space 61*a* of the storage chamber 61. In this case, by moving the rod 63 to the cleaning chamber 62 side, the fluid 201 stored in the tank 30 is sucked.

By opening the second port 51*b* and the third port 51*c* and closing the first port 51*a*, the fluid 201 stored in the space 61*a* of the storage chamber 61 is supplied to the switching valve 52 side (the nozzle 20 or the discharge unit 40). In this case, by moving the rod 63 inside the space 61*a* of the storage chamber 61 (e.g., away the cleaning chamber 62 side), the fluid 201 stored in the space 61*a* is pushed out.

By opening the first port 51*a* and the third port 51*c* and closing the second port 51*b*, the remaining fluid 201 stored in the tank 30 is discharged to the discharge unit 40 via the switching valve 52 and the on-off valve 53.

The cleaning chamber 62 is provided on a side of the storage chamber 61 opposite to a side from which the fluid 201 is discharged (for example, an end portion of a side opposite to a side where the opening 61*b* is provided). The cleaning chamber 62 may change a volume of a space for storing the cleaning liquid 202. An end portion of the cleaning chamber 62 on a side opposite to the storage chamber 61 side may be movable in a direction along which the storage chamber 61 and the cleaning chamber 62 are aligned.

For example, the cleaning chamber 62 includes a stretchable portion 62*a*, a flange 62*b*, and a flange 62*c*.

The stretchable portion 62*a* has a cylindrical shape and includes a space 62*a*1 for storing the cleaning liquid 202 therein. The stretchable portion 62*a* may be stretchable in the direction along which the storage chamber 61 and the cleaning chamber 62 are aligned. For example, the stretchable portion 62*a* may include a stretchable side wall. For example, the stretchable portion 62*a* may include a side wall with a bellows structure. A material of the stretchable portion 62*a* is not particularly limited as long as the material has resistance to the cleaning liquid 202 and resistance to repetition of stretching and is easy to stretch. The stretchable portion 62*a* may be formed of, for example, a fluorine resin.

The flange 62*b* has a plate shape, and is provided at one end portion of the stretchable portion 62*a*. The flange 62*b* may include a hole 62*b*1 penetrating in a thickness direction. The hole 62*b*1 serves as a flow path of the cleaning liquid 202.

The flange 62*c* has a plate shape, and is provided at the other end portion of the stretchable portion 62*a*. The flange 62*c* may include a hole 62*c*1 penetrating in the thickness direction. The hole 62*c*1 serves as a flow path of the cleaning liquid 202.

A material of the flange 62*b* and the flange 62*c* is not particularly limited as long as the material has resistance to the cleaning liquid 202 and a certain degree of rigidity. The flange 62*b* and the flange 62*c* may be formed of, for example, stainless steel or a fluorine resin. In this case, if the stretchable portion 62*a*, the flange 62*b*, and the flange 62*c* are formed of the same material, they are integrally molded.

The rod 63 may have a columnar shape. The rod 63 may have a cylindrical shape, for example. The rod 63 extends in the direction along which the storage chamber 61 and the cleaning chamber 62 are aligned. The rod 63 is provided through the hole 62*c*1 of the flange 62*c*, the space 62*a*1 of the stretchable portion 62*a*, the hole 62*c*1 of the flange 62*b*, and the space 61*a* of the storage chamber 61. That is, one end portion of the rod 63 is provided inside the cleaning chamber 62, and the other end portion of the rod 63 is provided inside the storage chamber 61. Therefore, one end portion of the rod 63 is in contact with the cleaning liquid 202, and the other end portion of the rod 63 is in contact with the fluid 201. The rod 63 is movable in the direction along which the storage chamber 61 and the cleaning chamber 62 are aligned with stretching of the cleaning chamber 62.

In this case, the rod 63 is not exposed to the outside air. Therefore, the fluid 201 adhered to the side surface of the rod 63 is removed by the cleaning liquid 202, and even if there is unremoved fluid 201, the fluid 201 does not be solidified. Therefore, it is possible to prevent the solidified fluid 201 from mixing into the fluid 201 in the space 61*a* of the storage chamber 61.

If the rod 63 is not exposed to the outside air, the outside air is not caught inside the cleaning chamber 62 as the rod 63 reciprocates. Therefore, it is possible to prevent generation of air bubbles in the cleaning liquid 202 stored in the cleaning chamber 62, and further in the fluid 201 stored in the storage chamber 61.

A material of the rod 63 is not particularly limited as long as the material has resistance to the fluid 201 and the cleaning liquid 202 and a certain degree of rigidity. The rod 63 may be formed of, for example, stainless steel.

The driving unit 64 may move the end portion of the cleaning chamber 62 on a side opposite to the storage chamber 61 side in the direction where the storage chamber 61 and the cleaning chamber 62 are aligned. The driving unit 64 may stretch the stretchable portion 62*a* in the direction where the storage chamber 61 and the cleaning chamber 62 are aligned to move the rod 63.

The driving unit 64 includes a frame 64*a*, a guide 64*b*, an attachment portion 64*c*, a motor 64*d*, and a transmission portion 64*e*.

The frame 64*a* includes a base portion 64*a*1 and an attachment portion 64*a*2. The base portion 64*a*1 has a plate shape, and may be provided parallel to the direction where the storage chamber 61 and the cleaning chamber 62 are aligned. The attachment portion 64*a*2 has a plate shape and may be provided perpendicular to one surface of the base portion 64*a*1. The attachment portion 64*a*2 is provided with a hole 64*a*2*a* penetrating in the thickness direction. The rod 63 is movable inside the hole 64*a*2*a*. A seal member 64*a*2*b* such as an O-ring may be provided between the rod 63 and an inner wall of the hole 64*a*2*a*. The storage chamber 61 may be provided on one surface of the attachment portion 64*a*2. The flange 62*b* of the cleaning chamber 62 may be provided on the other surface of the attachment portion 64*a*2. A seal member 64*a*2*c* such as an O-ring may be provided between the attachment portion 64*a*2 and the flange 62*b*.

The guide 64*b* is provided on a surface of the base portion 64*a*1 on a side where the attachment portion 64*a*2 is provided. The guide 64*b* may move the attachment portion 64*c* in the direction where the storage chamber 61 and the cleaning chamber 62 are aligned. The guide 64*b* may be, for example, a linear motion bearing.

The attachment portion 64*c* may be provided on the guide 64*b*. The attachment portion 64*c* has a plate shape and may be provided parallel to the attachment portion 64*a*2. The flange 62*c* of the cleaning chamber 62 may be provided on a surface of the attachment portion 64*c* facing the attachment unit 64*a*2. A seal member 64*c*2 such as an O-ring may be provided between the attachment portion 64*c* and the flange 62*c*. The rod 63 may be fixed to the attachment portion 64*c*.

The motor 64*d* and the transmission portion 64*e* cooperate to move a position of the attachment portion 64*c*. The motor 64*d* includes a detector such as an encoder, and may perform position control. The motor 64*d* may be, for example, a pulse motor or a servo motor. The detector for position control may be provided separately from the motor 64*d*. The transmission portion 64*e* may be, for example, a screw mechanism such as a ball screw, a timing belt, a pulley, or a rack-and-pinion.

The cleaning liquid supply unit 65 includes a tank 65*a*, a check valve 65*b*, a check valve 65*c*, and a flow rate regulating valve 65*d*.

The tank 65*a* may store the cleaning liquid 202. A material of the tank 65*a* is not particularly limited as long as the material has resistance to the cleaning liquid 202 and has a certain degree of rigidity. The tank 65*a* may be formed of, for example, stainless steel or a fluorine resin.

The check valve 65*b* is provided between the tank 65*a* and the cleaning chamber 62. The check valve 65*b* may allow the cleaning liquid 202 to be supplied from the tank 65*a* to the cleaning chamber 62, and prevent the supply of the cleaning liquid 202 from the cleaning chamber 62 to the tank 65*a*.

The check valve 65*c* is provided between the tank 65*a* and the cleaning chamber 62. The check valve 65*c* may allow the cleaning liquid 202 to be supplied from the cleaning chamber 62 to the tank 65*a*, and prevent the supply of the cleaning liquid 202 from the tank 65*a* to the cleaning chamber 62.

The flow rate regulating valve 65*d* is provided between the tank 65*a* and the cleaning chamber 62. The flow rate regulating valve 65*d* may regulate a flow rate of the cleaning liquid 202. The flow rate regulating valve 65*d* may be, for example, a needle valve. The flow rate regulating valve 65*d* may be provided as necessary.

Next, an operation of the pump 60 will be described.

When the fluid 201 is discharged from the pump 60, the driving unit 64 moves the attachment portion 64*c* in a direction approaching the attachment portion 64*a*2. Then, the rod 63 fixed to the attachment portion 64*c* is inserted into the space 61*a* of the storage chamber 61, and the fluid 201 corresponding to the moving amount of the rod 63 is discharged from the opening 61*b*. The fluid 201 discharged from the opening 61*b* is supplied to the switching valve 52 side (the nozzle 20 or the discharge unit 40) via the second port 51*b* and the third port 51*c* of the switching valve 51. The discharge amount of the fluid 201 may be controlled by controlling the moving amount of the rod 63, that is, the position of the rod 63.

Further, by moving the attachment portion 64*c* in the direction approaching the attachment portion 64*a*2, the cleaning chamber 62 (stretchable portion 62*a*) contracts. That is, a volume of the cleaning chamber 62 (stretchable portion 62*a*) decreases. Then, the cleaning liquid 202 corresponding to the contraction amount flows out from the cleaning chamber 62 and flows into the tank 65*a* via the check valve 65*c*.

When the fluid 201 is supplied to the pump 60, the driving unit 64 moves the attachment portion 64*c* in a direction away from the attachment portion 64*a*2. Then, the rod 63 fixed to the attachment portion 64*c* is pulled out from the space 61*a* of the storage chamber 61, and the fluid 201 corresponding to the moving amount of the rod 63 is sucked from the tank 30 via the opening 61*b*, and the first port 51*a* and the second port 51*b* of the switching valve 51. The supply amount of the fluid 201 may be controlled by controlling the moving amount of the rod 63, that is, the position of the rod 63.

Further, by moving the attachment portion 64*c* in the direction away from the attachment portion 64*a*2, the cleaning chamber 62 (stretchable portion 62*a*) expands. That is, the volume of the cleaning chamber 62 (stretchable portion 62*a*) increases. Then, the cleaning liquid 202 corresponding to the expansion amount is sucked from an inside of the tank 65*a* via the check valve 65*b*.

In the pump 60 according to the present embodiment, the rod 63 is not exposed to the outside air. Therefore, even when the fluid 201 is adhered to the side surface of the rod 63, the fluid 201 does not be solidified. As a result, it is possible to prevent the solidified fluid 201 from mixing into the fluid 201 in the space 61*a* of the storage chamber 61. The outside air is not caught inside the cleaning chamber 62 as the rod 63 reciprocates as long as the rod 63 is not exposed to the outside air. Therefore, it is possible to prevent generation of air bubbles in the cleaning liquid 202 stored in the cleaning chamber 62, and further in the fluid 201 stored in the storage chamber 61.

Figure 4:
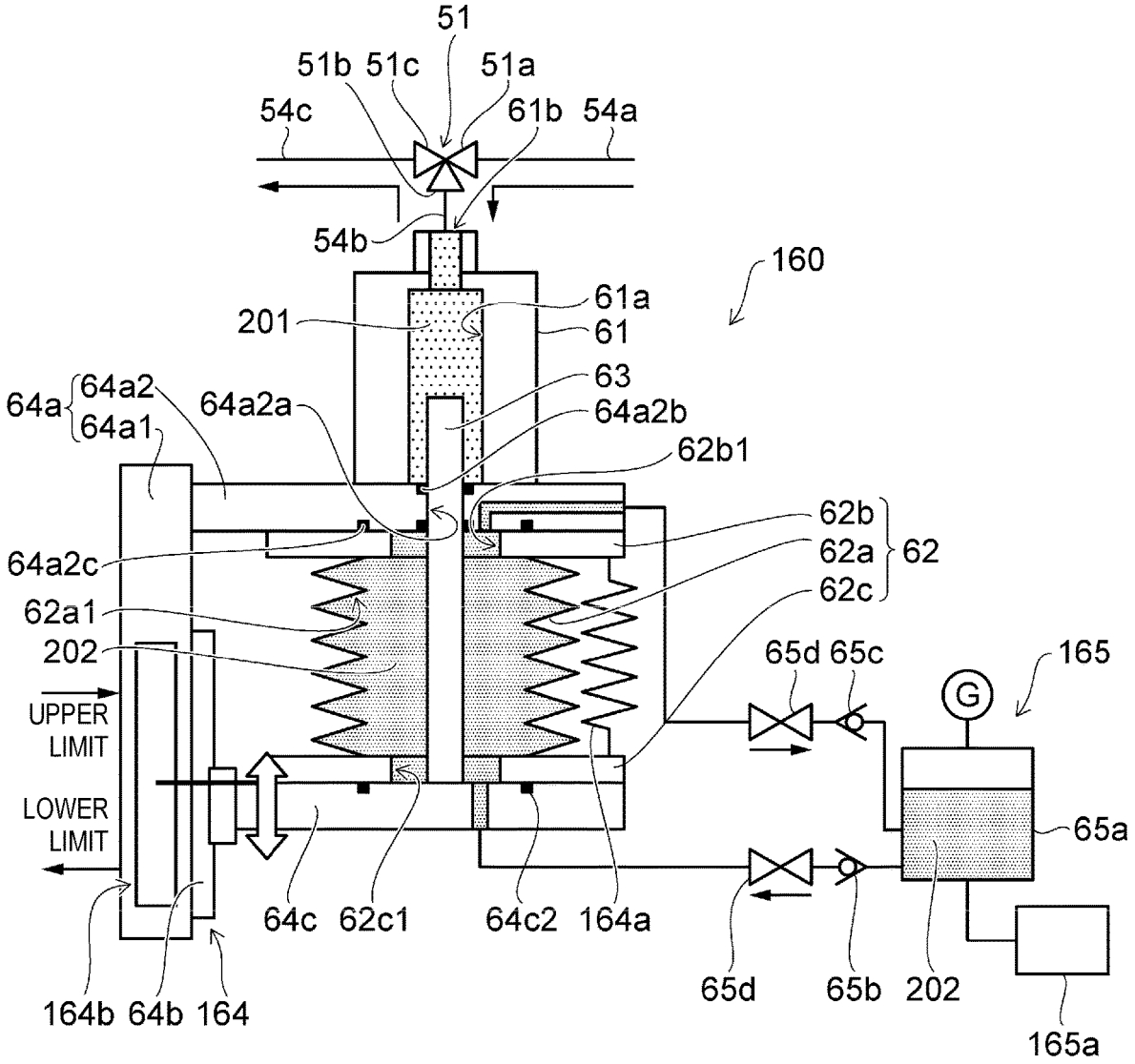
FIG. 4 is a schematic cross-sectional view showing a pump according to another embodiment.

FIG. 4 is a schematic cross-sectional view showing a pump 160 according to another embodiment.

As shown in FIG. 4, the pump 160 includes the storage chamber 61, the cleaning chamber 62, the rod 63, a driving unit 164, and a cleaning liquid supply unit 165.

The driving unit 164 stretches the stretchable portion 62*a* in a direction along which the storage chamber 61 and the cleaning chamber 62 are aligned to move the rod 63.

The driving unit 164 includes the frame 64*a*, the guide 64*b*, the attachment portion 64*c*, an elastic body 164*a*, and a detection unit 164*b*.

The elastic body 164*a* moves the attachment portion 64*c* in a direction approaching the attachment portion 64*a*2 by an elastic force. The elastic body 164*a* may be, for example, a tension spring provided between the attachment portion 64*c* and the attachment portion 64*a*2.

The detection unit 164*b* may detect a position of the attachment portion 64*c*, and further the moving amount of the rod 63. The detection unit 164*b* may be, for example, a position sensor such as a linear scale.

The cleaning liquid supply unit 165 includes the tank 65*a*, the check valve 65*b*, the check valve 65*c*, the flow rate regulating valve 65*d*, and a pressure control unit 165*a*.

The pressure control unit 165*a* may control a pressure in a space of the cleaning chamber 62. The pressure control unit 165*a* may change a volume of the space of the cleaning chamber 62 by controlling the pressure in the space of the cleaning chamber 62. For example, the pressure control unit 165*a* may control the pressure of the cleaning liquid 202 stored in the tank 65*a*. The pressure control unit 165*a* may control the volume of the tank 65*a* and further the pressure of the cleaning liquid 202 by changing a position of a piston provided inside the tank 65*a*, for example. The pressure control unit 165*a* may be, for example, a pump that controls the pressure of the cleaning liquid 202 by controlling the amount of the cleaning liquid 202 stored in the tank 65*a*.

Next, an operation of the pump 160 will be described.

When the fluid 201 is discharged from the pump 160, the pressure of the cleaning liquid 202 is reduced by the pressure control unit 165*a*. Then, the elastic body 164*a* moves the attachment portion 64*c* in a direction approaching the attachment portion 64*a*2. Therefore, the rod 63 fixed to the attachment portion 64*c* is inserted into the space 61*a* of the storage chamber 61, and the fluid 201 corresponding to the moving amount of the rod 63 is discharged from the opening 61*b*. The fluid 201 discharged from the opening 61*b* is supplied to the switching valve 52 side (the nozzle 20 or the discharge unit 40) via the second port 51*b* and the third port 51*c* of the switching valve 51. The discharge amount of the fluid 201 can be controlled by regulating pressure control of the cleaning liquid 202 by the pressure control unit 165*a* based on the moving amount of the rod 63, that is, an output from the detection unit 164*b*.

When the fluid 201 is supplied to the pump 60, the pressure control unit 165*a* increases the pressure of the cleaning liquid 202. Then, the elastic body 164*a* extends, and the attachment portion 64*c* moves in a direction away from the attachment portion 64*a*2. Then, the rod 63 fixed to the attachment plate 64*c* is pulled out from the space 61*a* of the storage chamber 61, and the fluid 201 corresponding to the moving amount of the rod 63 is sucked from an inside of the tank 30 via the opening 61*b* and the first port 51*a* and the second port 51*b* of the switching valve 51. The supply amount of the fluid 201 can be controlled by regulating pressure control of the cleaning liquid 202 by the pressure control unit 165*a* based on the moving amount of the rod 63, that is, an output from the detection unit 164*b*.

Also in the pump 160 according to the present embodiment, the rod 63 is not exposed to the outside air. Therefore, the same effect as that of the pump 60 described above can be obtained.

Figure 5:
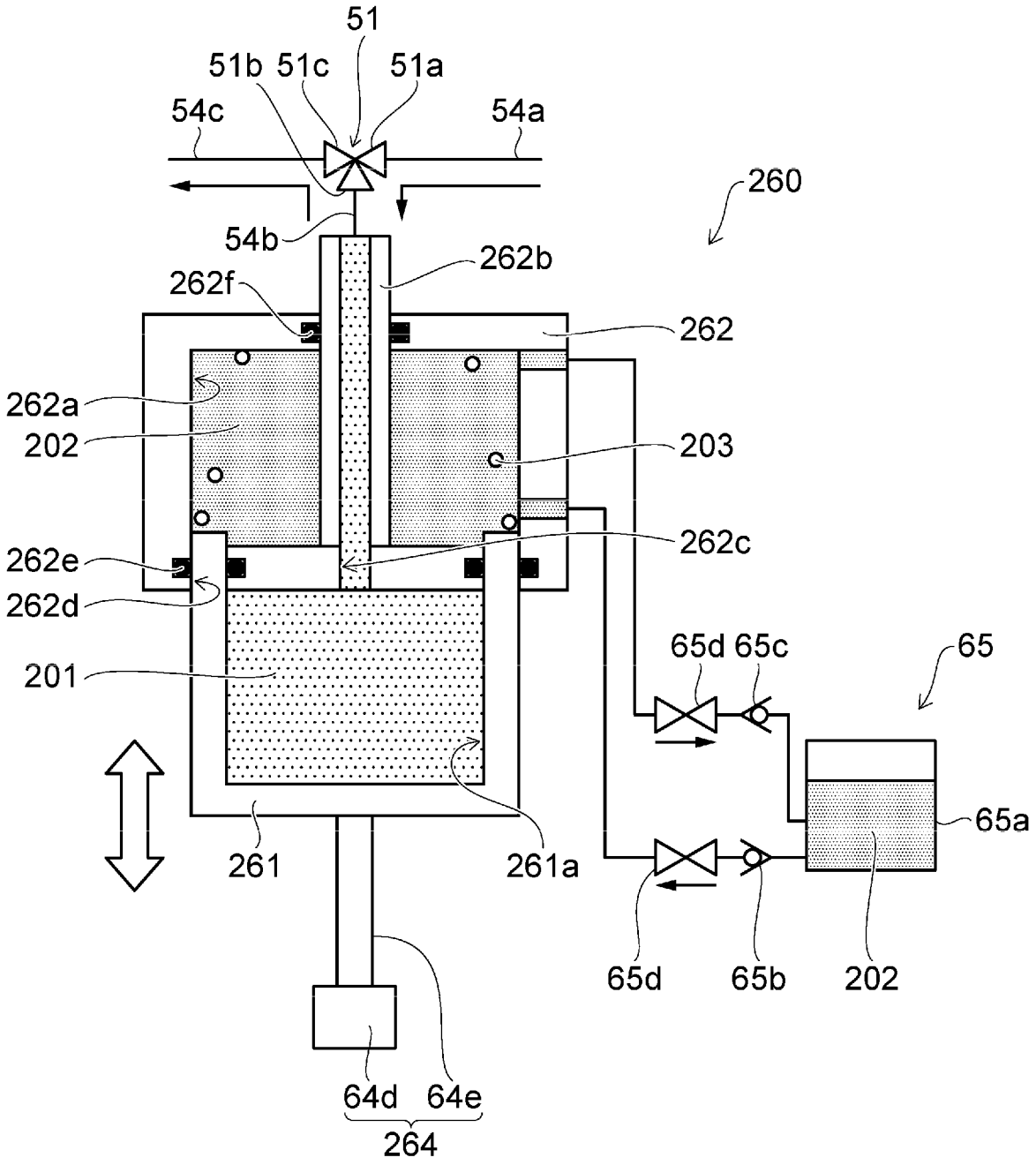
FIG. 5 is a schematic cross-sectional view showing a pump according to yet another embodiment.

FIG. 5 is a schematic cross-sectional view showing a pump 260 according to yet another embodiment.

As shown in FIG. 5, the pump 260 includes a storage chamber 261, a cleaning chamber 262, a driving unit 264, and the cleaning liquid supply unit 65.

The storage chamber 261 may have a cylindrical shape with an upper end portion being opened and a lower end portion being closed. The storage chamber 261 may have an opening at an upper end and store the fluid 201. The upper end of the storage chamber 261 may be inserted into a space 262*a* of the cleaning chamber 262 via a slit 262*d* provided on a bottom surface of the cleaning chamber 262. A seal member 262*e* such as an O-ring may be provided between an inner wall of the slit 262*d* and an outer side surface of the storage chamber 261. The storage chamber 261 has a space 261*a* for storing the fluid 201 therein. A material of the storage chamber 261 is not particularly limited as long as the material has resistance to the fluid 201 and has a certain degree of rigidity. The storage chamber 261 may be formed of, for example, stainless steel or a fluorine resin.

The cleaning chamber 262 is provided above the storage chamber 261. The cleaning chamber 262 has a box shape, and has the space 262*a* for storing the cleaning liquid 202 therein. A material of the storage chamber 262 is not particularly limited as long as the material has resistance to the cleaning liquid 202 and has a certain degree of rigidity. The cleaning chamber 262 may be formed of, for example, stainless steel or a fluorine resin.

In addition, a pipe 262*b* is provided in the cleaning chamber 262. One end portion of the pipe 262*b* may be provided on the bottom surface of the cleaning chamber 262. The other end portion of the pipe 262*b* may protrude to the outside of the cleaning chamber 262. A second port 51*b* of the switching valve 51 may be connected to the other end portion of the pipe 262*b* via the pipe 54*b*. A seal member 262*f* such as an O-ring may be provided between the other end portion of the pipe 262*b* and a wall surface of the cleaning chamber 262. A hole 262*c* is provided in a portion of the bottom surface of the cleaning chamber 262 where the pipe 262*b* is provided. A hole of the pipe 262*b* may be connected to the space 261*a* inside the storage chamber 261 via the hole 262*c*. A hole of the pipe 262*b* may be a flow path through which the fluid 201 flows. That is, one end portion of the pipe 262*b* may be connected to the inside of the storage chamber 261 via the hole 262*c* provided in the bottom surface of the cleaning chamber 262, and the other end portion of the pipe 262*b* may be exposed to the outside of the cleaning chamber 262.

The driving unit 264 may change a position of the storage chamber 261 in an upper-lower direction. The driving unit 264 may include the motor 64*d* and the transmission portion 64*e*.

Next, an operation of the pump 260 will be described.

When the fluid 201 is discharged from the pump 260, the storage chamber 261 is moved up by the driving unit 264. Then, the upper end of the storage chamber 261 is inserted into the space 262*a* of the cleaning chamber 262 via the slit 262*d* provided on the bottom surface of the cleaning chamber 262. At this time, the fluid 201 corresponding to the insertion amount of the cleaning chamber 262 is discharged from the pipe 262*b*. The fluid 201 discharged from the pipe 262*b* is supplied to the switching valve 52 side (the nozzle 20 or the discharge unit 40) via the second port 51*b* and the third port 51*c* of the switching valve 51. The discharge amount of the fluid 201 can be controlled by controlling the position of the storage chamber 261.

When the fluid 201 is supplied to the pump 260, the storage chamber 261 is moved downward by the driving unit 264. Then, the storage chamber 261 is pulled out from the space 262*a* of the cleaning chamber 262, and the fluid 201 corresponding to the moving amount of the storage chamber 261 is sucked from the inside of the tank 30 via the pipe 262*b* and the first port 51*a* and the second port 51*b* of the switching valve 51. The supply amount of the fluid 201 can be controlled by controlling the moving amount of the storage chamber 261, that is, the position of the storage chamber 261.

In the pump 260 according to the present embodiment, surfaces with which the fluid 201 comes into contact (inner wall of the storage chamber 261, inner surface of the slit 262*d* of the cleaning chamber 262, and inner wall of the pipe 262*b*) are not exposed to the outside air. Therefore, solidification of the fluid 201 can be prevented, and accordingly, the solidified fluid 201 can be prevented from mixing into the fluid 201 in the space 261*a* of the storage chamber 261.

In addition, even if outside air is caught into the cleaning chamber 262 as the reciprocation of the storage chamber 261 and the air bubbles 203 are generated, the air bubbles 203 gather on a ceiling side of the cleaning chamber 262. Therefore, it is possible to prevent the air bubbles 203 from moving to the inside of the storage chamber 261 provided below the cleaning chamber 262.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A pump comprising:

a first chamber configured to store a first fluid;

a second chamber configured to store a second fluid, the second chamber being positioned on a side of the first chamber and wherein a volume of a space of the second chamber configured to store the second fluid is variable; and an elongated member having a first end portion and a second end portion, the first end portion provided in the second chamber and the second end portion provided in the first chamber;

wherein the second chamber is opposite to a side from which the first fluid is discharged;

wherein the first fluid and the second fluid is different;

wherein the second fluid is a cleaning fluid; and wherein at least one end portion of the second chamber, provided on a side opposite the second chamber from the first chamber, is movable in a direction along which the first chamber and the second chamber are aligned.

2. The pump according to claim 1, wherein the second chamber is expandable in the direction along which the first chamber and the second chamber are aligned, and the elongated member is movable in the direction along which the first chamber and the second chamber are aligned.

3. The pump according to claim 1, further comprising:

a pressure controller configured to control a pressure in the space of the second chamber, wherein the pressure controller configured to change the volume of the space by controlling the pressure of the space.

4. The pump according to claim 1, wherein the elongated member is not exposed to outside air.

5. A pump, comprising:

a first chamber configured to store a first fluid;

a second chamber configured to store a second fluid, the second chamber being positioned on a side of the first chamber and wherein a volume of a space of the second chamber configured to store the second fluid is variable;

an elongated member having a first end portion and a second end portion, the first end portion provided in the second chamber and the second end portion provided in the first chamber; and a driver configured to move at least one end portion of the second chamber in a direction along which the first chamber and the second chamber are aligned;

wherein the second chamber is opposite to a side from which the first fluid is discharged;

wherein the first fluid and the second fluid is different;

wherein the second fluid is a cleaning fluid.

6. The pump according to claim 5, wherein the second chamber is expandable in the direction along which the first chamber and the second chamber are aligned, and the elongated member is movable in the direction along which the first chamber and the second chamber are aligned.

7. The pump according to claim 5, further comprising:

a pressure controller configured to control a pressure in the space of the second chamber, wherein the pressure controller configured to change the volume of the space by controlling the pressure of the space.

8. The pump according to claim 5, wherein the elongated member is not exposed to outside air.

9. A coating device comprising:

a pump according to claim 1; and a nozzle connected to an opening of the pump that discharges the first fluid.

10. A coating device comprising:

a pump according to claim 5; and a nozzle connected to an opening of the pump that discharges the first fluid.

* * * * *